US006472980B1

(12) United States Patent
Jen et al.

(10) Patent No.: US 6,472,980 B1
(45) Date of Patent: Oct. 29, 2002

(54) DEVICE WITH BUILT-IN SIGNAL DISCRIMINATION AND OUTPUT SYNCHRONIZATION CIRCUITS

(75) Inventors: Hsing C. Jen, Buffalo Grove; Fred M. Butalla, Orland Park; David P. Harter, St. Charles, all of IL (US)

(73) Assignee: Pittway Corporation, Chicago, IL (US)

( * ) Notice: Subject to any disclaimer, the term of this patent is extended or adjusted under 35 U.S.C. 154(b) by 0 days.

(21) Appl. No.: 09/559,790

(22) Filed: Apr. 27, 2000

(51) Int. Cl.[7] ..... G08B 29/00

(52) U.S. Cl. ..... 340/506; 340/286.05; 340/310.01; 340/331; 340/538

(58) Field of Search ..... 340/506, 628, 340/632, 517, 521, 541, 634, 525, 538, 539, 286.02, 286.05, 287, 288, 293, 505, 508, 512, 513, 331, 332, 333, 310.01

(56) References Cited

U.S. PATENT DOCUMENTS

| | | | | | |
|---|---|---|---|---|---|
| 4,257,038 | A | * | 3/1981 | Rounds et al. | 340/539 |
| 4,567,472 | A | * | 1/1986 | Shirai et al. | 340/525 |
| 4,567,475 | A | * | 1/1986 | Bukowiecki et al. | 340/634 |
| 5,051,723 | A | * | 9/1991 | Long et al. | 340/566 |
| 5,400,009 | A | | 3/1995 | Kosich et al. | |
| 5,559,492 | A | * | 9/1996 | Stewart et al. | 340/331 |
| 5,608,375 | A | | 3/1997 | Kosich | |
| 5,659,287 | A | * | 8/1997 | Donati et al. | 340/331 |
| 5,694,335 | A | * | 12/1997 | Hollenberg | 364/514 |
| 5,729,197 | A | * | 3/1998 | Cash | 340/539 |
| 5,751,210 | A | | 5/1998 | Kosich | |
| 5,850,178 | A | | 12/1998 | Ha et al. | |
| 5,959,528 | A | | 9/1999 | Right et al. | 340/506 |
| 5,982,275 | A | | 11/1999 | Kosich | |
| 6,040,769 | A | * | 3/2000 | Payne | 340/506 |
| 6,163,263 | A | * | 12/2000 | Tice et al. | 340/635 |
| 6,281,789 | B1 | | 8/2001 | Furtado et al. | 340/506 |

OTHER PUBLICATIONS

System Sensor, Small Package Big Benefits, CHECK™ Isolated Heat 4–Wire Form C Relay, Temporal Tone, Thermal Sounder Models, A05–1006–00–1/99–30K–#371, ©1999 System Sensor.

System Sensor, 100 Series Direct Wire Smoke Detectors, A05–227–09–1/99(25K)–#400, ©1999 System Sensor.

* cited by examiner

*Primary Examiner*—Daniel J. Wu
*Assistant Examiner*—Davetta W. Goins
(74) *Attorney, Agent, or Firm*—Welsh & Katz, Ltd.

(57) ABSTRACT

An electrical unit, such as an ambient condition detector, incorporates pattern discrimination circuitry. A received pattern is analyzed and, if it is in accordance with a predetermined pattern, the unit outputs an audible and/or visible indicium synchronized with the incoming pattern for the duration thereof. The unit also includes circuitry for emitting a corresponding output signal pattern to at least one other detector. A system which incorporates a plurality of electrical units, at least one of which has the pattern discrimination circuitry produces at least one synchronized audible or visible output indicative of a predetermined condition throughout the system. Patterns can include predetermined tonal alarm indicating output patterns as well as predetermined visible alarm indicating output patterns.

29 Claims, 4 Drawing Sheets

DEVICE WITH BUILT-IN SIGNAL DISCRIMINATION AND OUTPUT SYNCHRONIZATION CIRCUITS

FIELD OF THE INVENTION

The invention pertains to monitoring systems. More particularly, the invention pertains to such systems which are capable of outputting synchronized audible or visible indicia indicative of the presence of an alarm condition.

BACKGROUND OF THE INVENTION

A variety of alarm systems for monitoring various ambient conditions in regions of interest are known. These systems, which include fire detection, gas detection or intrusion detection devices, often incorporate ancillary output devices such as horns or speakers or piezoelectric tone generating devices to produce various types of condition indicating audible outputs. Visible outputs which produce various pulsed light patterns are also known.

Advantages of standardized audible alarm signals have been recognized. One known standardized alarm signal with a predetermined temporal pattern has been defined by American National Standard Institute S3.41. It is also been recognized that various foreign jurisdictions might specify a different standard.

Beyond publicly issued standards, it has been recognized that there are advantages to synchronizing the various audible and visible outputs. One known synchronizing approach is disclosed and claimed in U.S. Pat. 5,850,178 entitled "Alarm System having Synchronizing Pulse Generator and Synchronizing Pulse Missing Detector" assigned to the assignee hereof and incorporated herein by reference. While known synchronization approaches and methods have been found to be useful, there continues to be a need for synchronization systems and methods which respond to evolving needs.

SUMMARY OF THE INVENTION

An electrical device usable in a multiple device communication system incorporates control circuitry for receiving and analyzing received signal patterns. In response to a received predetermined signal pattern, a synchronized output is generated. In one aspect, the output can be produced by a transducer. Exemplary transducers include audible output devices and visual output devices.

In yet another aspect of the invention, the unit includes discrimination circuitry which initially recognizes that a predetermined pattern has been received and which energizes an output transducer in accordance with subsequently received predetermined patterns. In this embodiment, the output transducer will continue to be driven, in synchronism with the received patterns until the incoming patterns cease.

The output transducer can be driven to produce a pattern identical to a received pattern. Alternately, the synchronized output can be provided in the form of a different pattern.

In another aspect, the control circuitry incorporates a programmed processor and associated pre-stored executable instructions along with at least one pre-stored output pattern. Upon receipt of an incoming pattern which is substantially similar to the pre-stored output pattern, the processor in turn causes the output transducer, which could be audible or visible, to emit a synchronized pattern. As noted above, the synchronized pattern can be identical to the. received pattern. Alternately, it can be synchronized to the received pattern but distinguishable therefrom.

The electrical unit can in turn generate at a selected output port an output pre-determined synchronizing pattern to be coupled to other electrical units. In such an event, the coupled output synchronizing pattern from the first unit causes the subsequent units to emit a synchronized audible and/or visible output signal corresponding to the received signal. Alternately, the audible and/or observable output signals can be synchronized with a received input pattern but can be distinguishable therefrom.

In one embodiment, an electrical unit which has recognized the presence of a predetermined condition, such as fire, gas or intrusion, can enter a state indicative thereof. That unit can in turn output a synchronizing pattern to units coupled thereto. In response to receipt of the synchronizing pattern, those units can emit a synchronized audible/visible output either substantially identical thereto or synchronized therewith but distinguishable therefrom.

In another embodiment, a common control element can be coupled to the various electrical units. The synchronizing audible/visible signal can be originated by the common control element in response to detection of an alarm condition.

The synchronizing signal can in turn be coupled to a plurality of electrical units in the system either directly or in daisy-chain fashion by causing the units to emit a signal corresponding to the received synchronization signal from the panel. The emitted signal is received by other electrical units in the system causing same to output a synchronized audible/visible indicia.

In yet another embodiment, a signal discrimination module can be coupled to the control element. This module can in turn detect the presence of a synchronizing output-signal from the control element. It can in turn couple that signal to a plurality of electrical units which do not incorporate the above noted discrimination circuitry.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
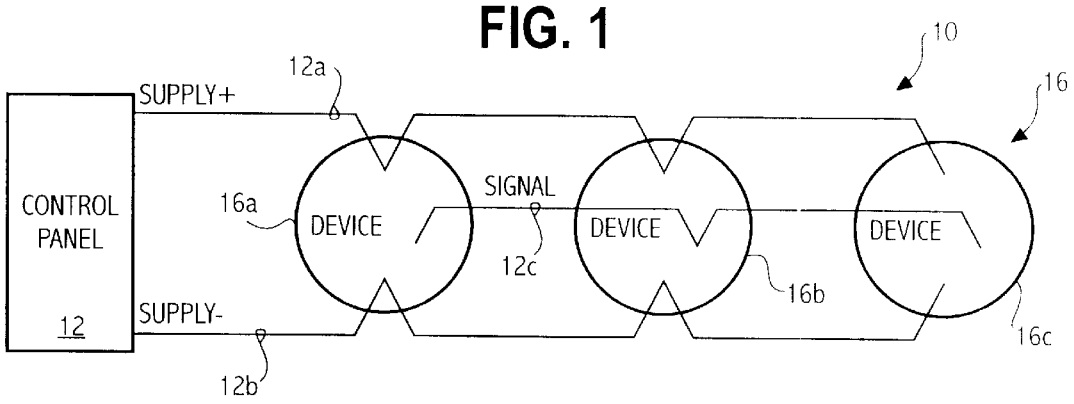
FIG. 1 is a block diagram of a system which embodies the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 in accordance with the present invention. The system 10 includes a control panel 12 of a conventional variety as would be understood by those of skill in the art. Conductors 12*a* and 12*b* are coupled from panel 12 to a plurality of devices 16. The conductors 12*a*, 12*b* can be used to provide electrical energy from the control panel 12 to devices 16. Additionally, as is known to those of skill in the art, they can be used to transmit information from the panel 12 to the various devices 16 or, alternately, from one or more of the devices 16 to the panel 12.

The plurality of devices 16 includes devices 16*a*, 16*b*, 16*c*, and so on to the extent that the conductors 12*a*, 12*b* can adequately service the remaining devices 16*m*, 16*n*.

Figure 7:
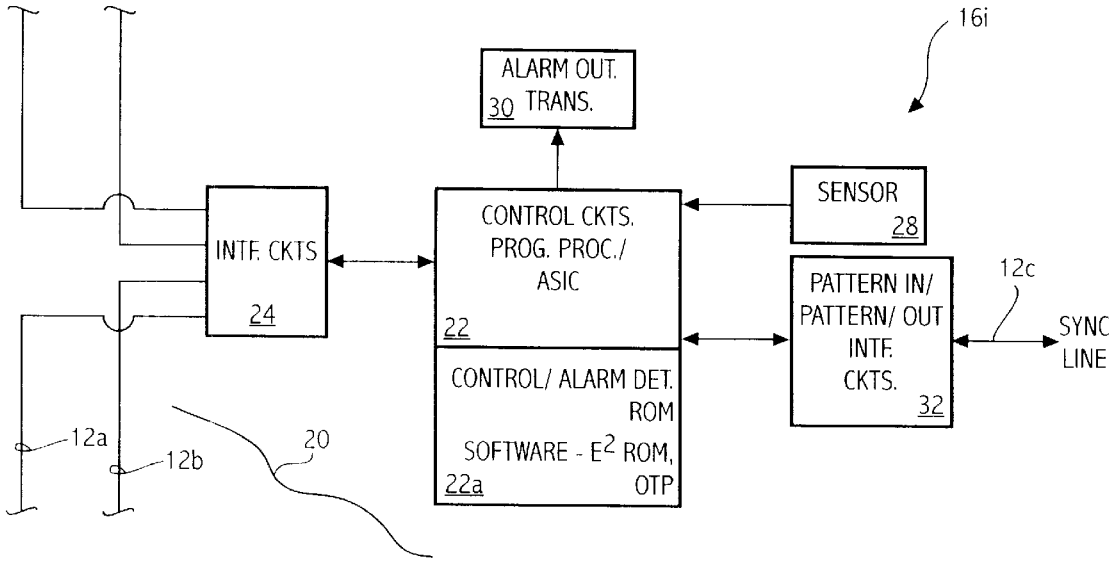
FIG. 7 is a block diagram of an exemplary electrical unit usable in the systems of FIGS. 1 and 3.

The members of the plurality 16 are, for example, ambient condition detectors such as the detector 16*i* illustrated in block diagram form in FIG. 7. The detector 16*i* includes a housing generally indicated at 20 which supports the components thereof.

Detector 16*i* includes control circuitry 22 which could be implemented, for example, as an application specific integrated circuit (ASIC) or, preferably as a programmed processor. Processor 22 is coupled via interface circuits 24 to conductors 12*a*, 12*b*. Processor 22 in combination with circuits 24 carries out processing of a known type relative to control panel 12 which would be understood by those of skill in the art.

Processor 22 is also coupled to and receives signals from an ambient condition sensor 28. Sensor 28 could be implemented for example as a fire sensor to sense heat, smoke, flame or the like, all without limitation. Alternately, sensor 28 can be implemented as a gas sensor, a switch closure such as a fire alarm pull switch, a position indicator, a movement or intrusion detector, also without limitation.

Processor 22 includes alarm detection software 22a whereby signals from sensor 28 are analyzed in processor 22, using alarm detection software 22*a* to determine if an alarm condition is present. If so, processor 22 via interface circuits 24 can notify the alarm control panel 12. Additionally, the device 16*i* carries a local alarm output transducer 30 which is coupled to and can be driven by processor 22. Transducer 30 could be implemented for example as an audio sounder such as a piezoelectric output device or horn. Alternately, it could be implemented as a strobe light for generating pulses of human discernable radiant energy.

Hence, in response to the determination of an alarm at programmed processor 22, the alarm output transducer can be energized to produce an audible output or a visual output. One known audible output has been specified by American National Standard Institute S3.41.

Device 16*i* also includes-pattern input/output interface circuitry 32 coupled to control circuitry 22. Control circuitry 22, via interface 32 monitors input signals for the presence of predetermined patterns as discussed below.

With reference to FIG. 1, system 10 includes a synchronization synch signal communication line 12*c*. The line 12*c* extends between the devices, such as the device 16*i* of FIG. 7. The pattern input/pattern output interface 32 is coupled between synchronization line 12*c* and the control element, preferably program processor 22.

In the event that electrical device 16*i* has detected the presence of an alarm condition and entered an alarm state in addition to driving the local alarm output transducer 30, it will in turn produce an electrical signal on the line 12*c* which exhibits a synchronizing pulse pattern, corresponding to the pulse pattern being used to drive transducer 30 to the remaining devices in the plurality 16. The remaining devices in a plurality 16 will in turn detect the presence of a pre-specified pattern on the line 12*c* and will in turn drive their local alarm output transducer in synchronism with the same pattern as is used to drive the output transducer of the electrical device, such as the device 16*i* which has gone into alarm. This provides a synchronized audio and/or visible output signal at each of the devices in the plurality 16.

The members of the plurality 16 can be programmed to either match the incoming recognized alarm pattern, from line 12*c* and output the same pattern at their local output transducer or detect an acceptable incoming signature and then output a different pattern.

Figure 2:
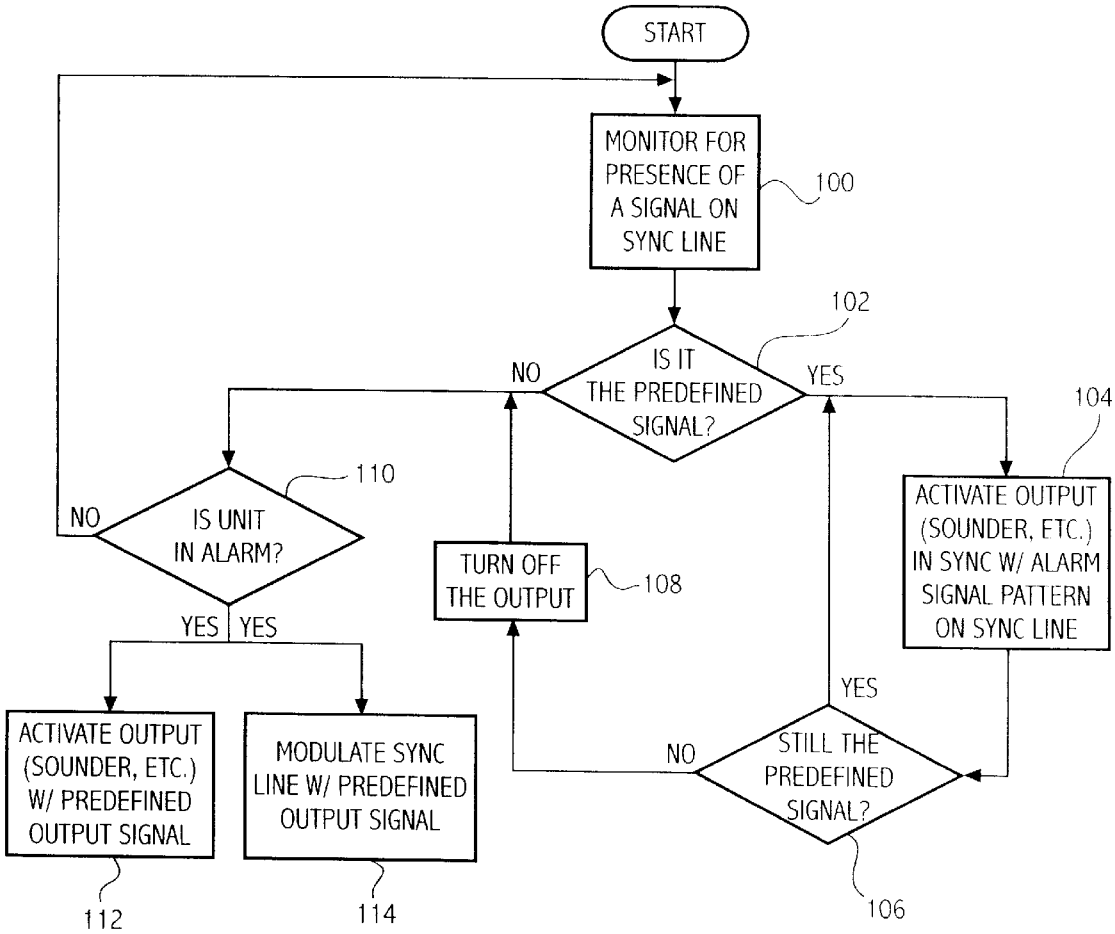
FIG. 2 is a flow diagram illustrating various aspects of the operation of the system of FIG 1.

FIG. 2 illustrates a flow diagram of the processing carried out by the processor 22 in a device 16*i* in a quiescent state. The processor 22 will monitor line 12*c* for the presence of a synchronizing signal in step 100. In the event that one or more of the pre-defined signals is recognized in a step 102, the local alarm transducer 30 will be activated in synchronism in a step 104 in response to the incoming pattern on the sync line 12*c*.

So long as the incoming pattern continues to be repeated on the line 12*c*, in a step 106, the device 16*i* will continue to drive the local output transducer 30 in synchronized fashion. When the incoming pulse train on the line 12*c* ceases, the processor 22 ceases to drive the local output transducer 30 in a step 108. In such an event, if the device 16*i* is not in alarm, step 110, it will return to quiescent state and continue to monitor the sync line 12*c*.

On the other hand, if the device 16*i* is in alarm, it will in a step 112 activate the local alarm output transducer 30 indicating the-presence of an alarm condition at device 16*i*. Additionally, by means of interface 32, in a step 114 a modulated synchronizing output pulse train will be coupled to line 12*c*. This signal will in turn activate remaining devices in the plurality 16 causing them to emit a synchronized audible and/or visual output signal.

The system 10 thus, via the plurality of electrical units 16 can emit synchronized tonal or visual output patterns at the members of the plurality 16 in response to one of those members having gone into alarm.

Figure 3:
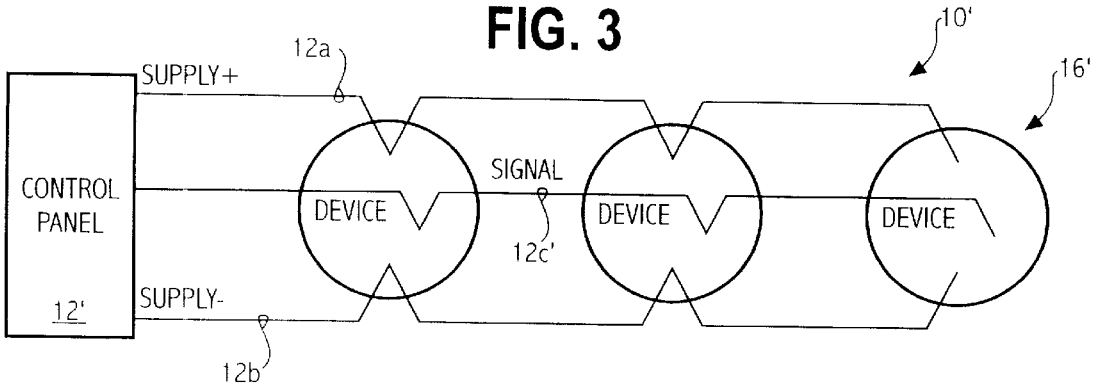
FIG. 3 is a block diagram of an another system which embodies the present invention.

FIG. 3 illustrates an alternate system 10' which includes control panel 12' coupled by conductors 12*a*, 12*b* to devices 16'. In the embodiment of FIG. 3, a synchronizing line 12*c'* extends between panel 12' and each of the members of the plurality 16'. In this embodiment, a member of the plurality 16', such as the device 16*i* which has gone into alarm notifies control panel 12' in a conventional fashion, for example by shunting lines 12*a*, 12*b*.

In response to the panel 12' detecting the presence of an alarm condition, which might include for example a fire alarm or an intrusion alarm or a gas alarm depending on the type of device which has sensed the condition, the control panel in turn generates a synchronization output signal on the line 12*c'* which is coupled to each of the members of the plurality 16'. Members of the plurality 16' correspond generally to the structure previously discussed in FIG. 7 with respect to device 16*i* with those changes which would be appropriate thereto based on the subsequent discussion of the operation of the devices in the plurality 16'.

The members of the plurality 16' can in turn be programmed so as to detect a pattern on the line 12*c'* to which they were intended to respond. For example, the pattern on the line 12*c*' might be a pattern for a fire alarm or could be a pattern for an intrusion alarm. In the former case, devices which were to indicate fire alarms would respond to the respective pattern, for example, by energizing their local fire alarm output transducer, corresponding to transducer 30 thereby producing a synchronized audible output pattern indicating a fire alarm. Alternately, in the event that panel 12' issues an intrusion signal on the line 12*i*, only those devices in the plurality 16' which incorporated intrusion alarms would respond thereto and go off. Once again, when the panel 12' terminated signals on the line 12*c*', the output devices would also cease being activated.

Figure 4:
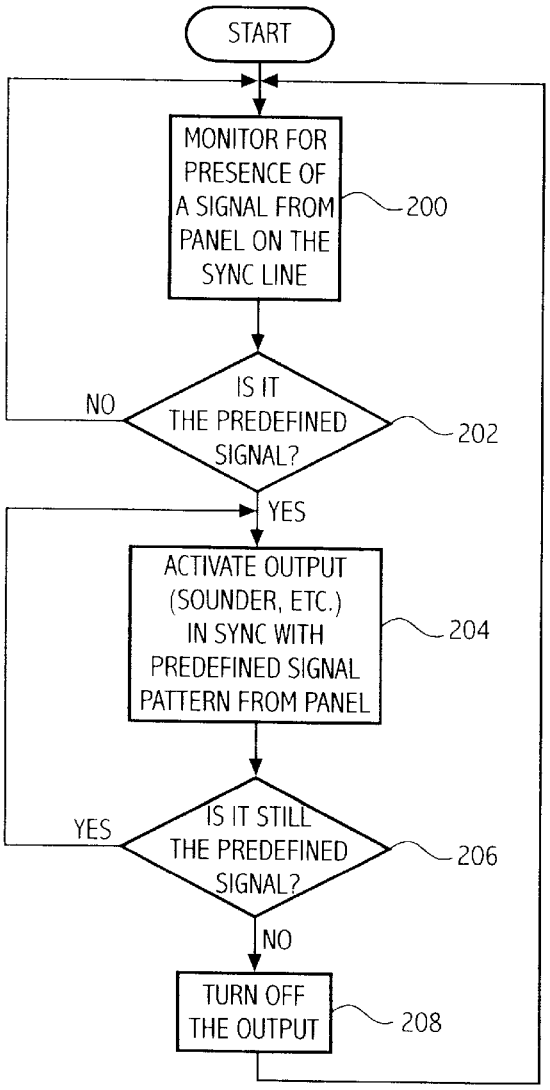
FIG. 4 is a flow diagram illustrating various aspects of the operation of the system of FIG. 3.

FIG. 4 illustrates a process implementable in the members of the plurality 16' which includes in a step 200 monitoring the line 12*c*' for the presence of a signal from the panel 12'. In the event that a pre-defined signal is recognized on the line 12*c*' in a step 202, the appropriate local output transducer, for example a fire alarm or an intrusion alarm will be then energized by the respective devices in the plurality 16', in a step 204 to thereby produce a pre-defined synchronized sound or visual pattern in response to the panels signals. In the event that the panel ceases driving the line 12*c*', in a step 206, the output is then turned off in a step 208.

With respect to the systems 10 or 10', the respective synchronization signals could for example include:

1. Pulses temporally spaced apart and corresponding to a predetermined audible or visual standard;
2. AC signals, for example, 3 kHz tones, sent in synchronized groups on the synchronizing lines 12*c* or 12*c*' to produce a predetermined audible or visual output in synchronism.

Figure 5:
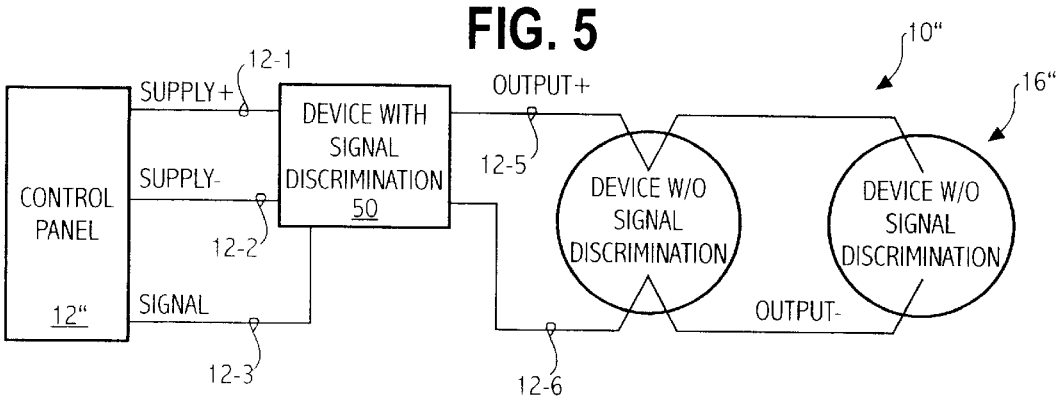
FIG. 5 is a block diagram of yet another embodiment of the present invention.

FIG. 5 illustrates an alternate system 10". The system 10"includes a control panel 12" which is coupled via conductors 12-1 and 12-2 to a synchronizing module 50. A synchronizing signal is coupled from panel 12" to module 50 via conductor 12-3.

In the system 10", the module 50 is in turn coupled via conductors 12-5 and 12-6 to a plurality of devices 16". The system 10" produces synchronized audible/visible output at the devices 16" in response to synchronization signals coupled thereto via module 50. These signals in turn all originate at control panel 12'. The devices in the plurality 16" could, for example, be fire detectors, gas detectors, or intrusion detectors, all without limitation. Additionally, they could be merely audible/visible output devices. Devices such as devices 16*i* modified to detect the patterns present on lines 12-5 and 12-6 could be used in system 10".

Figure 6A:
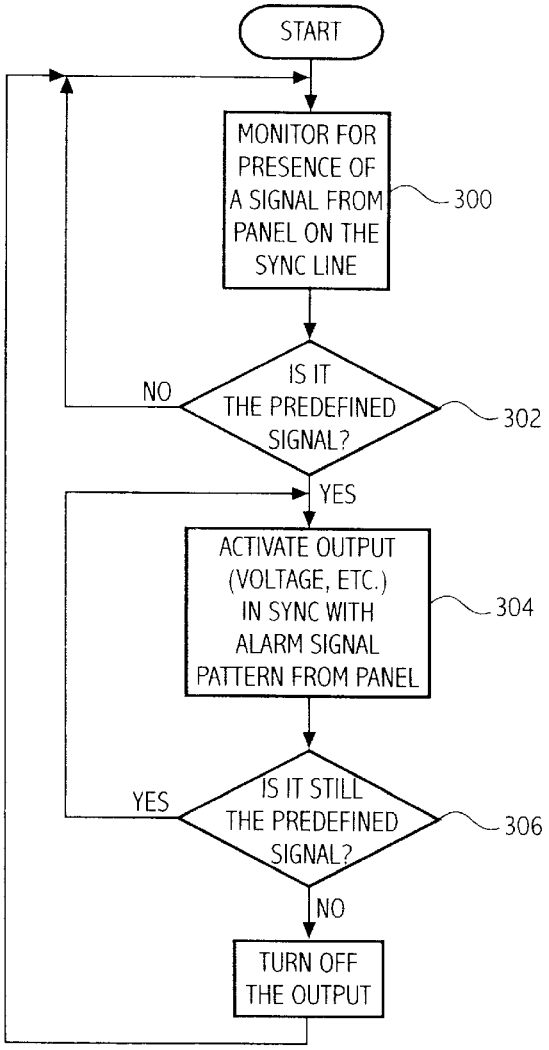
FIG. 6 is a flow diagram of various aspects of the operation of FIG. 5.
Figure 6B:
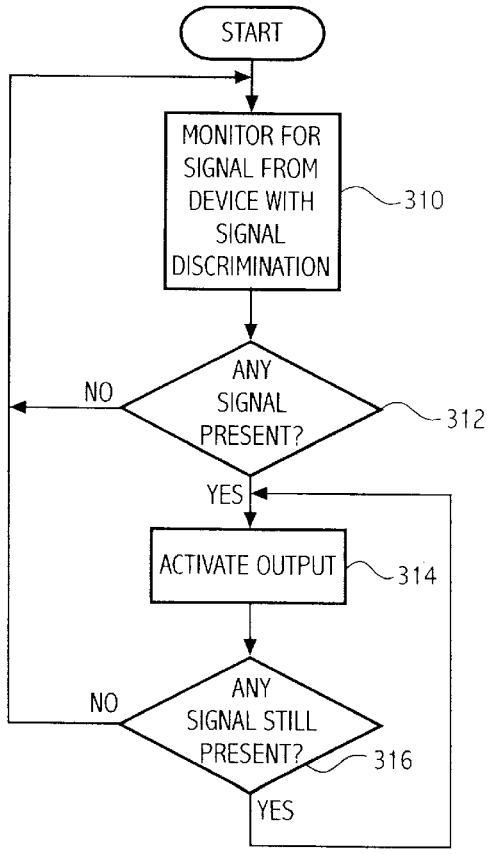

FIG. 6 illustrates flow diagrams for the synchronizing device or module 50, left column, as well as members of the plurality 16" right column. As illustrated in FIG. 6, the module 50 monitors the line 12-3 in a step 300 for the presence of a synchronizing signal from the panel. In step 302, in the event that it is the predefined signal, the conductors 12-5 and 12-6 are activated with a selected output voltage or current pattern in synchronism with the alarm signal from the panel 12".

So long as the panel continues to provide the synchronizing signal on the line 12-3 in a step 306, the devices in the plurality 16" will continue to receive the signals from the unit 50. Each of the members of the plurality 16" monitors the lines 12-5, 12-6 in a step 310 for the presence of the selected signals. In the presence of any signal or signals, detected in a step 312, the respective local output device, fire alarm or intrusion alarm is activated in a step 314. That device will continue to be activated in a step 316 so long as the device 50 continues to provide the signals.

It will be understood that the device 50 as well as members of the plurality of 16" could all couple alarm indicating signals to panel 12". Representative devices would include fire detectors, intrusion detectors and gas detectors, all without limitation.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A multi-device system comprising:

a combined power supply/communications link;

a separate synchronizing link;

a plurality of devices coupled to both links wherein at least one of the devices includes interface circuitry for receiving externally generated signal patterns from the synchronizing link, and additional circuitry responsive to at least one predetermined, received signal pattern for generating a local output in synchronization with the received signal pattern, wherein the at least one device includes an ambient condition sensor, and control circuitry coupled thereto for establishing the presence of a predetermined ambient condition and circuitry responsive thereto for coupling a signal pattern indicative thereof to the synchronizing link.

2. A system as in claim 1 wherein the discrimination circuitry comprises a programmed processor.

3. A system as in claim 1 wherein the at least one device includes an output transducer of human discernable indicia which the additional circuitry energizes in synchronism with a received predetermined signal pattern.

4. A system as in claim 3 wherein the output transducer, when energized, outputs a human discernable counterpart to the received, predetermined signal pattern.

5. A system as in claim 3 wherein the output transducer, when energized, outputs a human discernable output having a different temporal pattern than the received, predetermined signal pattern.

6. A system as in claim 3 wherein at least some of the devices include at least one ambient condition sensor.

7. A system as in claim 6 wherein at least some of the sensors respond to indicia indicative of a fire.

8. A system as in claim 7 wherein at least some of the devices include circuitry, responsive to output from a respective sensor for recognizing the presence of an alarm condition.

9. A system as in claim 1 wherein the at least one device generates the local output in response to the established presence of the ambient condition.

10. A system as in claim 9 wherein the control circuitry generates the local output in synchronism with the signal pattern coupled to the synchronizing link.

11. A system as in claim 9 wherein the ambient condition sensor is selected from a class which includes a fire sensor, a gas sensor, an intrusion sensor, a position sensor and a motion sensor.

12. A system as in claim 11 wherein another of the devices includes a sensor of a different ambient condition wherein the another device couples a different signal pattern to the synchronizing link than the signal pattern coupled to that link by the at least one detector.

13. A system as in claim 1 wherein the at least one detector includes circuitry for storing at least one predetermined signal pattern.

14. A system as in claim 13 wherein the circuitry compares the stored signal pattern to received, externally generated signal patterns.

15. A system as in claim 1 which includes a common control element, coupled to both links wherein the control unit generates at least some of the patterns on the synchronization link.

16. A system as in claim 15 wherein another of the devices includes an ambient condition sensor and control circuits coupled thereto for establishing the presence of a predetermined ambient condition, and interface circuitry for coupling a condition indicating signal indicative thereof to the combined link.

17. A system as in claim 16 wherein the common control element, in response to receiving the condition indicating signal, couples a pattern indicative thereof to the synchronizing link.

18. A system as in claim 1 wherein some of the devices include at least one local output device selected from a class which includes an audio output device and a visual output device.

19. A system as in claim 12 wherein some of the devices comprise one of a fire detector and a gas detector and others comprise at least one of an intrusion sensor, a position sensor and a motion sensor, and wherein the fire detectors emit a first signal pattern on the synchronizing link and the some of the devices emit a different signal pattern on the link.

20. A monitoring system of a type having a common control element with a power supplying/communication link extending therefrom comprising:

a plurality of ambient condition detectors coupled to the link wherein the dectectors receive power from the link, and, in response to a sensed, predetermined condition couple a condition indicating signal to the link;

a synchronizing line which extends at least between the detectors for transmission of synchronizing signals between detectors whereby in response to one of the detectors sensing the predetermined condition, condition specific synchronizing signals are coupled to the synchronizing line and to the detectors.

21. A system as in claim 20 wherein the control element includes circuitry for coupling the synchronizing signals to the line.

22. A system as in claim 20 wherein at least some of the detectors include circuitry for coupling the synchronizing signals to the line.

23. A detector usable in an alarm system comprising:

a housing;

a control circuit carried by the housing;

a power input, carried by the housing and coupled to the control circuit, for receipt of electrical energy from an external source;

a synchronizing input/output terminal carried by the housing and coupled to the control circuit;

an ambient condition sensor, carried by the housing and coupled to the control circuit, whereby the control circuit establishes the presence of a predetermined condition;

local output circuitry coupled to the control circuit, for generating local alarm signals, responsive to an established local predetermined condition;

synch interface output circuits coupled between the input/output terminal and the control circuits, responsive to the established local predetermined condition for coupling a repetitive output pattern, synchronized with the local signals, to the input/output terminal.

24. A detector as in claim 23 which includes synch interface input circuits, coupled to the input/output terminal, for receipt of respective synchronizing patterns and circuits for converting the received patterns to local alarm signals synchronized therewith.

25. A detector as in claim 23 wherein the control circuit, responsive to the established predetermined condition, couples a signal indicative thereof to the power terminal.

26. A detector as in claim 24 which includes storage for at least one synchronizing pattern.

27. A detector as in claim 24 wherein the local alarm signals exhibit the same pattern as received at the input/output terminal and are synchronized therewith.

28. A detector as in claim 27 wherein when the patterns received at the input/output terminal cease the circuits cease converting.

29. A detector as in claim 28 which includes an audible output device coupled to the local output circuitry and the audible output pattern therefrom is the same as the pattern received at the input/output terminal.

* * * * *